US005131660A

United States Patent [19]

Marocco

[11] Patent Number: 5,131,660

[45] Date of Patent: Jul. 21, 1992

[54] PUTTER

[76] Inventor: Joseph Marocco, 12 Winding Branch, Hawthorne Woods, Ill. 60047

[21] Appl. No.: 627,594

[22] Filed: Dec. 14, 1990

[51] Int. Cl.[5] ..... A63B 53/00; A63B 69/36

[52] U.S. Cl. ..... 273/186 A; 273/162 R; 273/163 R

[58] Field of Search ..... 273/186 R, 186 A, 186 C, 273/162 R, 163 R

[56] References Cited

U.S. PATENT DOCUMENTS

| | | | |
|---|---|---|---|
| 1,712,537 | 5/1929 | White | 273/186 A |
| 2,630,012 | 3/1953 | Walker | 273/186 A |
| 3,270,564 | 9/1966 | Evans | 273/186 A X |
| 3,293,755 | 12/1966 | Cronwell | 273/163 R X |
| 3,424,462 | 1/1969 | Driscoll | 273/162 R |
| 3,466,046 | 9/1969 | McTeigue | 273/162 R |

*Primary Examiner*—William H. Grieb

*Attorney, Agent, or Firm*—Michael, Best & Friedrich

[57] ABSTRACT

An improved putting device is disclosed having a mechanism for measuring the backstroke distance of the putters club head during use, means for converting the measurement into an electronic signal, a microprocessor for calculating the distance a golf ball will travel when struck with the backstroke indicated by the electronic signal, a liquid crystal display electronically connected to the microprocessor for displaying to the user in alpha-numeric form the distance the ball will travel and a battery for providing electrical current to the device. Programing may be also provided for measuring club head speed and force if required.

20 Claims, 2 Drawing Sheets

Fig. 7
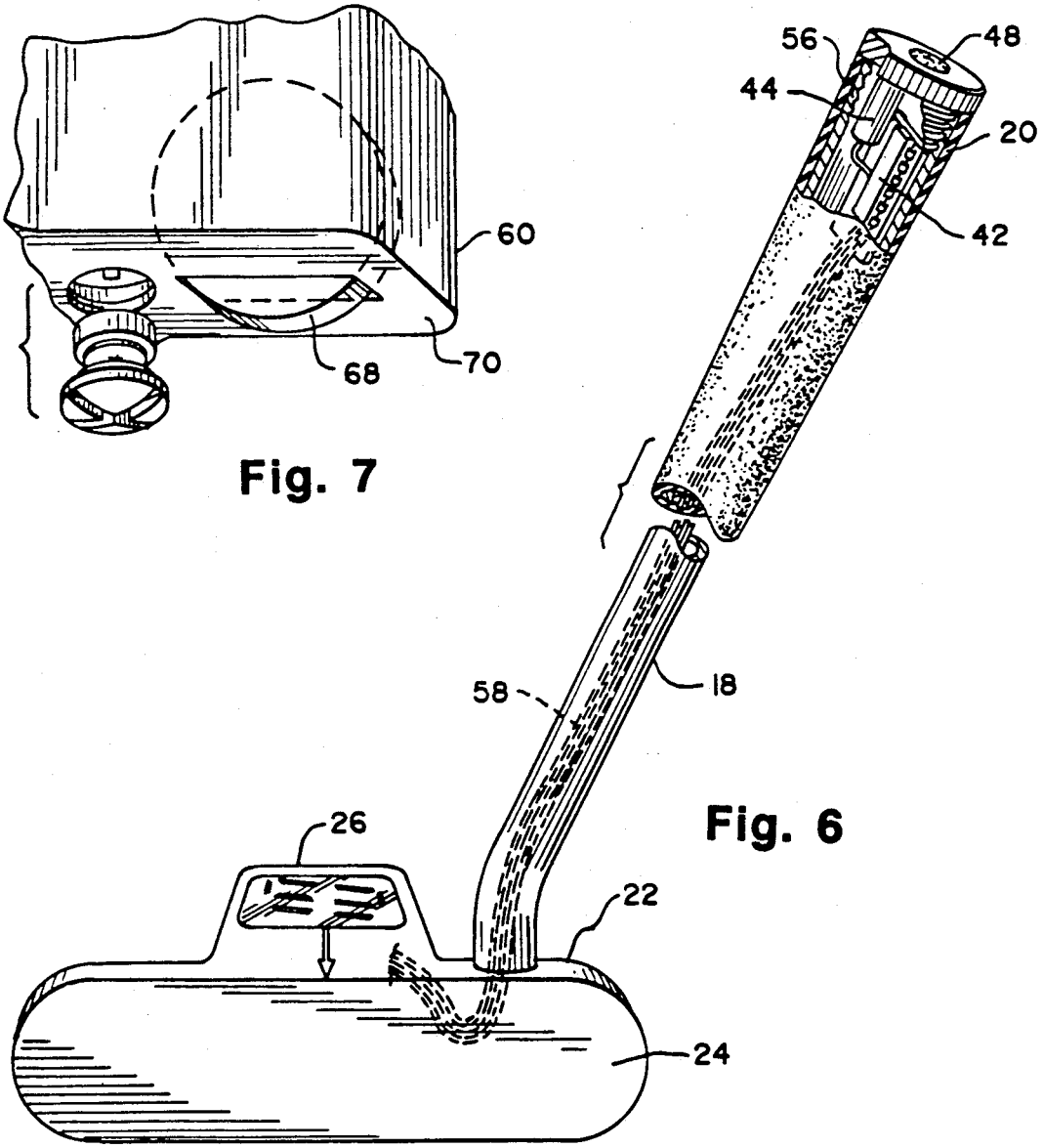
Fig. 6
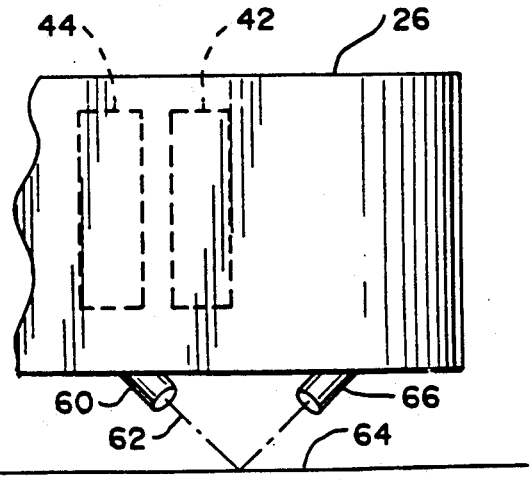
Fig. 8

PUTTER

The invention relates generally to putters and more particularly to an improved putting device which allows the user to more precisely determine the amount of backstroke, the club head speed, and the estimated distance that the ball will travel when practicing his putting game.

BACKGROUND OF THE INVENTION

A wide variety of devices have been developed in order to improve the ability of golfers, in the areas of both driving, chipping and putting. For example, U.S. Pat. No. 2,630,012 discloses a golf club velocity indicating device. The device is adapted to be mounted on the shaft of a golf club such as a driver. However, the device is principally for measuring velocity when driving the ball and is not sensitive enough for determining club head speed of a putter.

U.S. Pat. No. 3,424,462 discloses a putter and backswing gauge that is mounted on the shaft of the putter. The backswing gauge includes an indicator for assisting and determining the optimum backstroke of a putter with relation to the distance between the lie of the ball and the cup. A straight edge scale is mounted on the shaft of the club between the striking club and the handle to extend horizontally when the shaft is vertical in addressing the ball in the direction of the cup. Visually aligning the ball with the point of the scale indicates the distance of the ball from the cup and the device also indicates the optimum length of the backstroke. However, this device has been found to be cumbersome because of the rod extending from the putter shaft and the hardware associated with the indicator mounted on the shaft.

U.S. Pat. No. 3,293,755 describes a device which assists in establishing putt direction. The device is placed on the green and not physically attached to the putter. U.S. Pat. No. 3,466,046 discloses a mechanical putter which is attached to the shaft of a conventional putter. The device includes a control mechanism comprising a rachet and a pawl arrangement associated with an angularly movable setting mechanism adapted to move the pawl out of engagement with the rachet when the putter has been moved rearwardly through a preselected arch, thereby permitting the putter to swing freely in a forward direction with a force determined by the extent of its reward motion. However, this device both physically operates the putter rather than merely assisting the user.

Two more recent devices are a "blade gauge" which helps the user align the putting face of the putter during use and a "true putt trainer" which is mirrored device placed on the ground have a series of scales to show backswing distances.

Although the aforesaid devices have been informative and helpful, those that are mounted on the shaft of the club tend to make the feel of swinging the club unnatural in relation to an ordinary putter used in competition play. In addition, the various gauges described are suitable only for use either at the home or office and not on the golf course.

Accordingly, it is an object of the present invention to provide a low cost, accurate method of providing precise information to the user of the required backstroke of a putt of a given distance, to indicate the club head speed so as to allow the user to become more consistent in his putting and to provide such a device which can be attached to existing putter, or designed as a modular unit.

SUMMARY OF THE INVENTION

One of the most difficult areas of golf is learning to putt the ball and to develop an accurate "feel" for how far the ball will travel based on the amount of backstroke; i.e. distance the putter blade is moved from perpendicular rearwardly. In order to accurately estimate the distance of the ball to the cup, many methods are available. Two in particular are to stride from the ball to the cup using each stride as a three foot measurement. The user will then read the grain of the green as well as the slope. The existence of uphill or downhill lies also effects the distance. In general, a downhill lie will decrease the amount of force required by approximately one-third (⅓), and an uphill lie will increase the amount of force required by approximately one-third (⅓) depending on conditions. The percentages can vary based on these conditions. Alternatively, hand held optical devices are now available which provide precise information as to the distance from the device to a selected point such as the cup.

In the present invention, an improved putter is provided for putting a golf ball more accurately on a green. A conventional putter includes a shaft, a handle portion at the top of the shaft and a head portion at the bottom of the shaft, the head having a striking face which in various putter designs may be in alignment with the shaft, or offset as desired. The present invention represents an improvement over prior art putters in that it provides a mechanism for measuring the backstroke distance of the club head from perpendicular. The measuring mechanism is fixedly attached to the club head itself. A mechanism is further provided for converting the measurement into an electronic signal which corresponds to the backstroke distance. A microprocessor electronically connected to the mechanism then calculates the distance a ball will travel when struck by the striking face of the putter with the backstroke indicated by the electronic signal; i.e. with the backstroke indicated times a desired club head speed. A liquid crystal display electronically connected to the microprocessor then displays to the user in alpha-numeric form the estimated distance that the ball will travel. A battery is electronically connected to the entire device.

In a preferred embodiment the measuring mechanism includes a pendulum which rotates as the club head is drawn backwardly during the backstroke of the user. An encoder wheel is vertically disposed in alignment with the strike face of the club. The encoder wheel rotates in response to the motion of the pendulum. The encoder wheel has one or more markings on it indicating the degree or extent of rotation. The mechanism for converting the measurement of the backstroke into an electronic signal comprises an interrupter head which is disposed either on one or both sides of the encoder wheel. The interrupter head reads either the number of stripes that pass it or measures displacement of a single point on the wheel, in order to determine the degree of rotation of the encoder wheel and to send an electronic signal corresponding thereto. Either an electronic eye or an infrared sensor may be used.

The microprocessor includes an adjusting mechanism which may be used to compensate the microprocessor in its calculations based on the slope of the green, the angle of the green, and the resistance of the green. This information is provided in what are called stempmeter readings which are provided at golf courses for each green. The adjustment mechanism comprises a thumb screw or a screw mechanism which may be rotated by a key so as to adjust upwardly or downwardly the reading of the device. The liquid crystal display previously described faces upwardly relative to the club face so as to facilitate a reading by the user. In a preferred embodiment, the device further includes a mechanism for calculating the club head speed during both the backstroke and forward stroke of the user. This is accomplished by reading the speed of rotation of the encoder wheel. The resulting calculation by the microprocessor is then displayed on either the same or a second liquid crystal display which faces upwardly toward the user. As a result the user can watch the liquid crystal display and practice maintaining club head speed at a desired rate as to make his entire game more consistent. Consequently, both the club head speed and a backstroke for a particular distances can be practiced until they are substantially uniform.

In an alternative embodiment of the invention the aforesaid microprocessor may be mounted in the handle of the putter rather than at the club head so as to reduce the weight of the club head. The microprocessor is electrically connected to the mechanism for measuring backstroke by means of a wire which runs through the shaft.

In a preferred embodiment the mechanism for measuring backstroke, the mechanism for converting the backstroke to an electronic signal and the microprocessor are contained within a housing fixedly attached to the rear portion of the club head and centrally disposed thereon so as to precisely maintain balance of the putter. This housing may be formed intricately with the putter or may be selectively attachable to the club head using magnets, screws, adhesive, brackets, or other commonly known attachment mechanisms.

As mentioned above, the device of the present invention may be used for calculating both back stroke and club head speed based on the speed of rotation of the encoder wheel which rotates at a speed determined by the speed of the club head. The interrupter head then reads the rotation of the encoder wheel and transmits an electronic signal to the microprocessor which calculates a club head speed and sends a signal to the liquid crystal display. The liquid crystal display then display an alpha-numeric indicia; i.e. a letter or number showing the club head speed. In a preferred embodiment both the backstroke length and the club head speed may be displayed simultaneously by having multiple sections one for each display. Alternatively, the liquid crystal display may alternate between the two readings.

In a preferred embodiment, on the base of the backstroke reading mechanism is an adjustment screw or stempmeter screw which may be used to adjust the calculations of the microprocessor based on the slope angle and grain resistance of the green. More specifically, rotation of the screw either with a finger movement or by use of a screw driver or cleat cleaner causes the microprocessor to compensate in desired increments either upwardly or downwardly depending on the upward or downward slope of the green, the angle and grain resistance. Preferably, the housing for this mechanism is centrally disposed on the club head and extend perpendicularly therefrom in the opposite direction as the striking face so as to provide a balance to the club head thereby preventing interference with ordinary utilization of the club.

In an additional alternative embodiment of the invention, the aforesaid mechanical apparatus may be replace by an infrared source mounted proximate the club head and directed downwardly therefrom. An infrared receiver is also mounted on the bottom of the club head facing downwardly. The receiver measures variations in the infrared beam reflected from ground caused by the speed of the club head. The receiver is connected to the microprocessor and sends a signal to the microprocessor. The microprocessor then calculates the club head speed and if desired the backstroke of the putter and send a signal to the liquid crystal display which displays either a piece of information or both in alphanumeric form.

In an additional alternative embodiment of the invention, club head speed and backstroke distance are measured using a wheel which is rotatably mounted proximate the club head and disposed so as to extend slightly below the club head. Rotation of this wheel is measured by use of either an encoder wheel or simple marking on the rotatable wheel is located beneath an interrupter head. The interrupter head then sends a signal to the microprocessor which converts the electronic signal from the interrupter head into a calculation of the club head speed and/or backstroke distance. The resulting calculations may then be displayed on a liquid crystal display.

In use a video may be provided for training the user in the use of the improved putter and to provide putting tips such as how to read greens, slopes and grass grain direction. The improved putter is designed primarily for training purposes but may be used for informal competition with the permission of other players.

BRIEF DESCRIPTION OF THE DRAWINGS

FIG. 6 of the drawings is an alternative embodiment of the improved putter of FIG. 1 showing in particular a putter having batteries and microprocessor located in the handle of the putter.

FIG. 7 of the drawings is a bottom exploded view of an alternative embodiment of the measuring device of FIG. 1 showing in particular a battery apparature, rotatable wheel and slot for the rotatable wheel.

FIG. 8 of the drawings is a side view of a alternative embodiment of the measuring device of FIG. 1 showing in particular an infrared speed and distance measuring device.

DETAILED DESCRIPTION OF THE PREFERRED EMBODIMENT

While the present invention is described in the specification and claims, the invention is not limited thereto except and so far as those who have the disclosure before them are able to make modifications and variations therein without departing from the scope of the claims.

Figure 1:
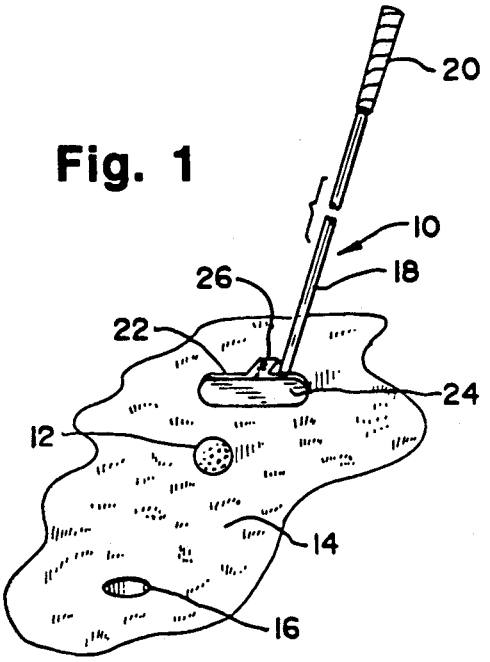
FIG. 1 of the drawings is a front perspective view of the improved putter of the present invention.

As shown in FIG. 1 of the drawings a improved putting device 10 is provided for putting a golf ball 12 on a green 14 into a hole 16. The putter 10 has a shaft 18, a handle portion 20 and a head 22 having a striking face 24. The present invention comprises an improvement over the prior art in that it has a mechanism 26 for measuring the backstroke of the club head during use. Mechanism 26 is fixedly attached to the club head 22 and oppositely disposed to the striking face 24.

Figure 4:
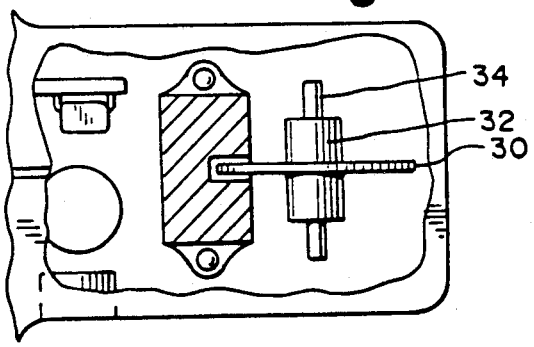
FIG. 4 of the drawings is a top view of the measuring mechanism of FIG. 3.
Figure 5:
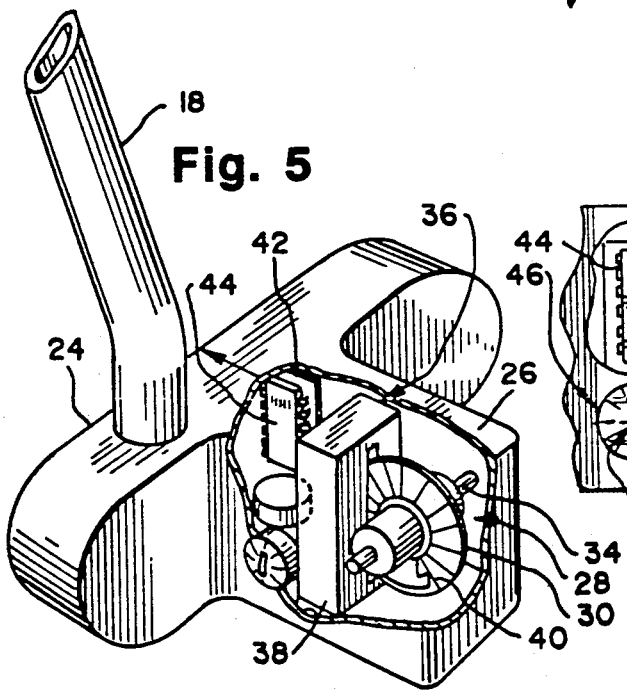
FIG. 5 is a top perspective view, partially broken away and partially exploded showing the improved putter of the present invention.
Figure 3:
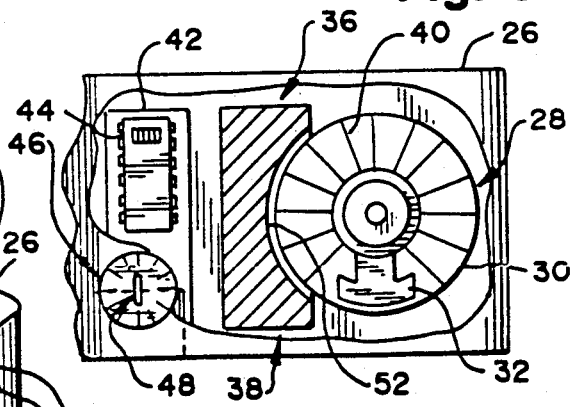
FIG. 3 of the drawing is a side exploded view of the internal workings of the measuring mechanism of the present invention.

Turning to FIG. 3 of the drawing, as shown in exploded view, mechanism 26 includes an apparatus 28 for measuring backstroke. In a preferred embodiment apparatus 28 comprises an encoder wheel 30 and pendulum 32 mount on a shaft 34 as seen in FIG. 4. Backward movement of club head 22 causes pendulum 32 to swing rearwardly thereby causing rotation of encoder wheel 28. A mechanism 36 is provided for converting the measurement of the rotation of the encoder wheel 28 into electronic signals or pulses. In a preferred embodiment mechanism 36 is a interrupter head 38 which electronically reads the one or more stripes 40 on encoder wheel 28 so as to measure the amount of rotation and thereby the distance of backstroke of the of the club head 22. A microprocessor 42 is electronically connected to the interrupter head 38 which converts the electronic signal from the interrupter head 38 into a signal indicative of the number of feet that a golf ball 12 will travel on a horizontal green of a standard resistance and at a standard club head speed. A battery 44, best shown in FIG. 5 of the drawings is electrically connected to microprocessor 42 and interrupter head 38 so as to provide electrical power thereto. As an additional feature, a rotatable stempmeter or adjustment gauge 46 is attached to the device 26. Stempmeter ratings for slope and grain resistance are provided by golf courses each day. Rotation of stempmeter 26 sets the rating for microprocessor 42 to reduce or increase the distance indicated by the device. The gradations 48 are slots on stempmeter dial 46 correspond to one foot increments for adjustment. On the opposite side of mechanism 26 is a liquid crystal display 50 which is electrically connected to microprocessor 42. After the calculations by the microprocessor 42 a signal is sent to liquid crystal display 50 which display in numeric or alpha-numeric indicia the number a feet a golf ball 12 will travel when struck with the backstroke indicated by the mechanism 26.

In an alternative embodiment of the invention, not shown, an electronic marker may be positioned on encoder wheel 28 or a single stripe or wedge shape may be affixed thereon. Interrupter head 38 is positioned, constructed and arranged for reading said one or more markings so as to indicate the degree of rotation and thereby the amount of backstroke that has been effected on the club head 22. In a preferred embodiment interrupter head 38 includes an electronic eye 52 which is pointed towards the sequential strips 40 so as to read the number of stripes passing it thereby provide a count as to the amount of rotation of the encoder wheel 28 thereby creating a reading a to the backstroke effected. In addition, a reading may also be given as to the distance the putter is stroked in a forward position. In a preferred embodiment liquid crystal display 50 faces upwardly on mechanism 26, as shown in FIG. 1, so as to enable the user to easily read the liquid crystal display during use.

As an additional feature of the invention, the measuring mechanism 26 may also be programed through microprocessor 42 to calculate the club head speed based on the amount of time required for each stripe to pass the electronic eye 52. The corresponding speed reading may then be converted by microprocessor 42 into a signal which is sent to liquid crystal display 50 for displaying in alpha-numeric form the club head speed. As a result, the user may practice using the putter 10 so as to maintain the club head speed at a substantially constant rate thereby providing uniformity during use in competition.

Turning now to FIG. 6 of the drawings in an alternative embodiment of the invention, the battery 44 and microprocessor 42 are mounted proximate the handle 20 of putter 10. A switch 54 is provided proximate the top 56 of handle 20 for selectively activating or deactivating the mechanism 26. The battery 44 and microprocessor 42 are electrically connected to mechanism 26 by means of a wire 58 which runs the length of the shaft 18.

Figure 2:
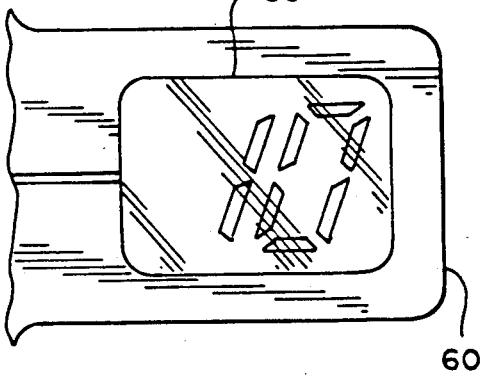
FIG. 2 of the drawings is a top view of the liquid crystal display and housing of the mechanism for measuring backstroke and/or club speed of the present invention.

It should be noted that in the embodiment shown, mechanism 26 is contained within a housing 60 best shown in FIG. 2. Housing 60 may be intricately formed with putter head 22 or separately attachable thereto. Attachment may be performed by several conventional methods such as magnets, screws, adhesive, or clips. Additionally, apparatus 26 may be sold separately from putter 10 so that it ma be attached to the users favorite putter. In any of these embodiments, it is preferable that the mechanism 26 be centrally disposed on the club head and extending perpendicularly therefrom and rearwardly in the opposite direction from the strike face 24 so as to provide balance to the club head 22.

As shown in FIG. 8 of the drawings, in an alternative embodiment of the invention, apparatus 26 comprises an infrared source 60 which directs an infrared beam 62 downwardly to the ground 64. The beam bounces on the ground and returns for reception by an infrared receiver 66. Infrared source 60 and infrared receiver 66 are electronically connected to a microprocessor 42 which calculates the rate of speed of the device 26 moving over the ground 64. Since the device 26 is attached to a club head 22, the rate of speed and the distance or backstroke of the club head 22 are determined. This information may then be sent to the liquid crystal display as shown in FIG. 2. As mentioned previously, in FIG. 3, interrupter head 38 may utilize an infrared beam located in the same position of the electronic eye 52 which directs a beam against the encoder wheel 28. Rotation of the encoder wheel 28 causes variations in the infrared beam which in turn are detected by an infrared detector such as infrared detector 66. Microprocessor 42 then calculates the backstroke of the club head and o the speed of the club head.

Turning now to FIG. 7 of the drawings, in an additional alternative embodiment of the invention, the backstroke of the club head 22 (not shown) and or the speed of the club head 22 may be determined by the use of a wheel 68 mounted on the bottom surface 70 of housing 60. Wheel 68 is rotatably mounted so that movement of club head 22 along the ground causes rotation of wheel 68. One or more stripes may be imprinted on wheel 68 which are in turn are detected by an interrupter head 38, best seen in FIG. 3. Interrupter head 38 then sends an electronic signal to microprocessor 42 which in turn displays either backstroke or club head speed or both on the liquid crystal display.

It should be further noted that microprocessor 42 may be programed to calculate the force with which the putter hits the ball using the formula force equals mass times acceleration. Since the mass of the club head can be programed in the microprocessor 42, and the speed and acceleration of the club head 22 can be determined by rotation of the encoder wheel 30, the resulting force can be determined and displayed on the liquid crystal display 50 if desired.

The foregoing merely explain and illustrate the invention and the invention is not limited thereto except in so far as those who have the disclosure before them are able to make modifications and variation therein without departing from the scope of the invention.

I claim;

1. An improved putter for putting a golf ball on a green said putter comprising a shaft, a handle portion, and a head having a striking face, the improvement comprising:

means for measuring the backstroke distance of said club head during use, said measuring means being fixedly attached to said club head;

means for converting said measurement into an electronic signal corresponding to said backstroke;

microprocessor means for calculating the distance a ball will travel when struck by said striking face with the backstroke indicated by said electronic signal;

a liquid crystal display electronically connected to said microprocessor means for displaying to the user in alpha-numeric form the distance the ball will travel as calculated by said microprocessor means when struck by said striking face with the backstroke indicated by said electronic signal; and battery means for providing electrical current to said measuring means, converting means, microprocessor means and liquid crystal display.

2. The improved putter of claim 1 wherein said measuring means for measuring the backstroke of the club head comprises a pendulum which moves as said club head is drawn backward during the backstroke of the user and an encoder wheel which rotates in response to rotation of pendulum said encoder wheel having one or more markings indicating the degree of rotation.

3. The improved putter of claim 2 wherein said means for converting said measurement into an electronic signal comprises an interrupter head disposed about said encoder wheel reading said interrupter head having means for said one or more markings on said encoder wheel and means for generating an electronic signal corresponding to the degree of rotation of said encoder wheel.

4. The improved putter of claim 3 wherein said one or more markings comprises a series of sequential stripes disposed radially on said encoder wheel, and said interrupter head comprises an electronic eye which counts the number of stripes and generates a corresponding electronic signal.

5. The improved putter of claim 3 wherein said one or more markings comprises a single stripe disposed radially on said encoder wheel and said interrupter head comprises an electronic eye which measures the degree of rotation of said stripe relative to perpendicular and generates a corresponding electronic signal.

6. The improved putter of claim 3 wherein said interrupter head comprises:

an infrared source for directing an infrared beam onto said encoder wheel;

an infrared detector for detecting the infrared beam reflected from said decoder wheel; and means for calculating with said microprocessor the backstroke of said club head in response to variations in said infrared beam caused by rotation of said encoder wheel.

7. The improved putter of claim 1 wherein said microprocessor means comprises an adjustment mechanism for compensating said calculation based on the slope, angle and grain resistance of the green.

8. The improved putter of claim 1 wherein said liquid crystal display faces upwardly relative to said club face so as to facilitate the reading of the liquid crystal display by the user.

9. The improved putter of claim 1 and further comprising:

means for calculating the speed of said club head during both the backstroke and forward stroke of the user; and means for displaying said club head speed on said liquid crystal display so as to enable the user to maintain said club head speed within a desired range.

10. The improved putter of claim 1 wherein said microprocessor and said battery are mounted in the handle of said putter so as to reduce the weight of said club head and are electrically connected to said means for measuring the backstroke distance of said club.

11. The improved putter of claim 1 and further comprising a housing for supporting and containing said means for measuring said means for connecting said measurement and said microprocessor proximate said club head.

12. The improved putter of claim 11 wherein said housing is integral with said club head.

13. The improved putter of claim 11 wherein said housing is centrally disposed on said club head and extends perpendicularly therefrom in the opposite direction as said striking face so as to provide a balance to said club head.

14. The improved putter of claim 1 wherein said microprocessor means comprises an adjustment mechanism for compensating said calculation based on the slope, angle and grain resistance of the green.

15. The improved putter of claim 1 wherein said microprocessor means further comprises means for calculating the force strike the ball, and means for displaying an alpha-numeric indication of said force on said liquid crystal display.

16. An apparatus for measuring the backstroke of a putter having a club head, a striking face, a shaft and a handle, said apparatus comprising:

a encoder wheel rotatably mounted proximate said club head, said encoder wheel having a pendulum attached thereto constructed and arranged for pivotal movement corresponding to the backstroke of said club head;

an interrupter head for converting said pivotal movement of said encoder wheel into an electronic signal;

a microprocessor for calculating the distance a golf ball will travel when struck by said striking face with the backstroke indicated by said electronic signal; and a liquid crystal display electrically connected to said microprocessor for displaying the distances the ball will travel when struck by said striking face with the backstroke indicated by said electronic signal.

17. The apparatus of claim 16 further comprising:

means for calculating the speed of said club head from the electronic signal from said interrupter head; and means for displaying said club head speed on said liquid crystal display.

18. The apparatus of claim, 17 wherein liquid crystal display includes means for displaying both the backstroke and the club head speed simultaneously.

19. An apparatus for measuring backstroke and club head speed of a putter having a club head, a shaft and a handle said apparatus comprising:

an infrared source mounted proximate said club head and directed downwardly therefrom;

an infrared receiver for directing the infrared beam reflected from the ground; and microprocessor means for determining backstroke distance and club head speed from variations in said reflected infrared beam.

20. An improved apparatus for measuring backstroke of a putter having a club head, a striking face, a shaft and a handle, said apparatus comprising:

a wheel rotatably mounted proximate said club head and disposed so as to extend slightly below the said club head;

means for measuring rotation of said wheel; and means for converting said measurement into an electronic signal and displaying said measurements in alphanumeric form.

* * * * *